United States Patent [19]

Hurley

[11] 4,055,269

[45] Oct. 25, 1977

[54] TANK FOR HOLDING LIQUID

[75] Inventor: Joseph John Hurley, Paisley, Scotland

[73] Assignee: J. & P. Coats Limited, Glasgow, Scotland

[21] Appl. No.: 686,906

[22] Filed: May 17, 1976

[30] Foreign Application Priority Data

May 20, 1975 United Kingdom ..... 21424/75

[51] Int. Cl.[2] ..... B65D 7/22; B65D 25/18

[52] U.S. Cl. ..... 220/10; 220/20.5; 220/9 A; 68/184; 68/DIG. 1

[58] Field of Search ..... 220/20, 20.5, 23.83, 220/9 A, 9 LG, 1 B, 1 V, 5 A, 10, 16, 23.2, 23.4, 20.5; 8/125; 68/184, 193, DIG. 1

[56] References Cited

U.S. PATENT DOCUMENTS

| | | | |
|---|---|---|---|
| 2,229,793 | 1/1941 | Bradley | 220/1 V |
| 2,594,244 | 4/1952 | Winternitz | 220/9 LG X |
| 2,897,657 | 8/1959 | Rupp | 220/10 X |
| 2,986,891 | 6/1961 | McMahon | 220/10 X |

*Primary Examiner*—William Price
*Assistant Examiner*—Steven M. Pollard

[57] ABSTRACT

A liquid holding tank incorporates a liquid-containing portion surrounded by thermal insulating material within a casing. The liquid-containing portion comprises an elongated horizontal chamber and at least one tubular shaft extending upwardly from the chamber. The elongated chamber may be segment-shaped in cross-section, the top being flat.

6 Claims, 2 Drawing Figures

TANK FOR HOLDING LIQUID

Figure 2:
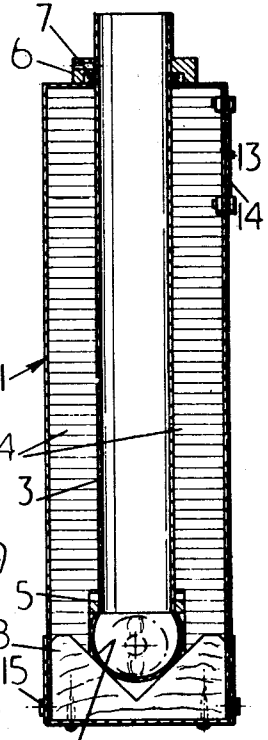

The subject of this invention is a tank for holding liquid, particularly for holding liquid while articles are treated in the liquid under conditions other than normal conditions such as conditions of severe vibration and conditions of high or low temperature. The tank of the invention is also particularly useful for treating articles in liquids which are corrosive and/or volatile or which would otherwise be classed as dangerous, while providing ready access to the liquid for articles to be treated with the liquid.

In processes requiring the short time treatment of a succession of articles with a liquid there must be ready access to the tank holding the liquid. To provide ready access the top of the tank must be open. Where the liquid is a hot liquid or is a cryogenic liquid, i.e. a liquid which remains liquid only at temperatures below normal room temperature, the open top of the tank promotes evaporation. This condition is aggravated where several articles are to be treated simultaneously in the tank for then the area of opening must be enough to admit the several articles at once. To maintain reasonable stability of temperature it is necessary to provide a volume of the liquid at the desired stable temperature which is considerably greater than is actually required. Apart from the danger of there being a large open expanse of volatile liquid it may be expensive and additionally dangerous to carry a large volume of the liquid stored in a single concentration.

A practical example of the problem may be seen in correction with the applicant's process for the treatment of cellulosic materials which is the subject of their prior Pat. No. 3,560,140. A step in the treating of thread by the process which is the subject of the prior patent consists in impregnating the thread with liquid ammonia ($NH_3$) which to keep it liquid must be at a temperature no higher than $-33°$ C. In performance of this process the thread is passed at high speed into and out of a bath of liquid ammonia. The bath must be kept open for continuous entry and exit of the thread, yet ammonia boils at $-33°$ C.

It is an object of the present invention to provide a tank which is arranged to provide continuous access, which will permit several articles to be immersed simultaneously, which presents the minimum surface area for the desired volume yet provides a store of the liquid substantially isolated from the ambient conditions.

A tank according to the invention incorporates a casing, an elongated chamber parallel to the bottom of the casing and located in the lower half of the casing, at least one tubular shaft extending upwardly from the chamber to the top of the casing, and thermal insulating material surrounding the chamber and the tubular shaft.

A tank intended for the simultaneous treatment of several articles contains several upwardly extending tubular shafts parallel with one another and all connected into the elongated chamber.

The elongated chamber and the tubular shafts may be of circular or polygonal cross section. Conveniently the elongated chamber is in cross section the shape of a segment of a circle, i.e., it is of part circular cross section with a flat top, the tubular shafts being connected into the elongated chamber through the flat top.

The ends of the elongated chamber may be closed by plugs or cover plates which may be arranged to be accessible from the exterior of the casing.

The top of the casing may be closed by a plate formed with holes through which the tubular shafts project. The tubular shafts may project through packings so that any liquid spilled from the tops of the tubular shafts cannot find its way into the insulation.

The elongated chamber may be formed of a circular section tube with a portion of the tube wall cut away between the ends of the tube and a plate bridging the cut edges.

In manufacture the tank may be formed complete and sealed without insulation and the insulating material may be of the type formed by the chemical reaction of two liquids incorporating a foaming agent. Such an insulation can be injected after the tank is constructed. One insulation which may be introduced in liquid form is liquid polystyrene containing a foaming agent. Where the tank is to contain cryogenic liquids this method of construction ensures that insulation is provided over every part of the surface of the elongated chamber and the tubular shafts.

Means for filling the elongated chamber and the tubular shafts and discharging liquid from the elongated chamber and the tubular shafts may be provided.

The tank may contain several elongated chambers each associated with at least one tubular shaft, the elongated chambers being preferably arranged parallel with one another. In such a construction the elongated chambers may be interconnected or may be isolated from one another thus permitting treatment using different liquids to be performed on different articles at the same time in the same tank.

Figure 1:
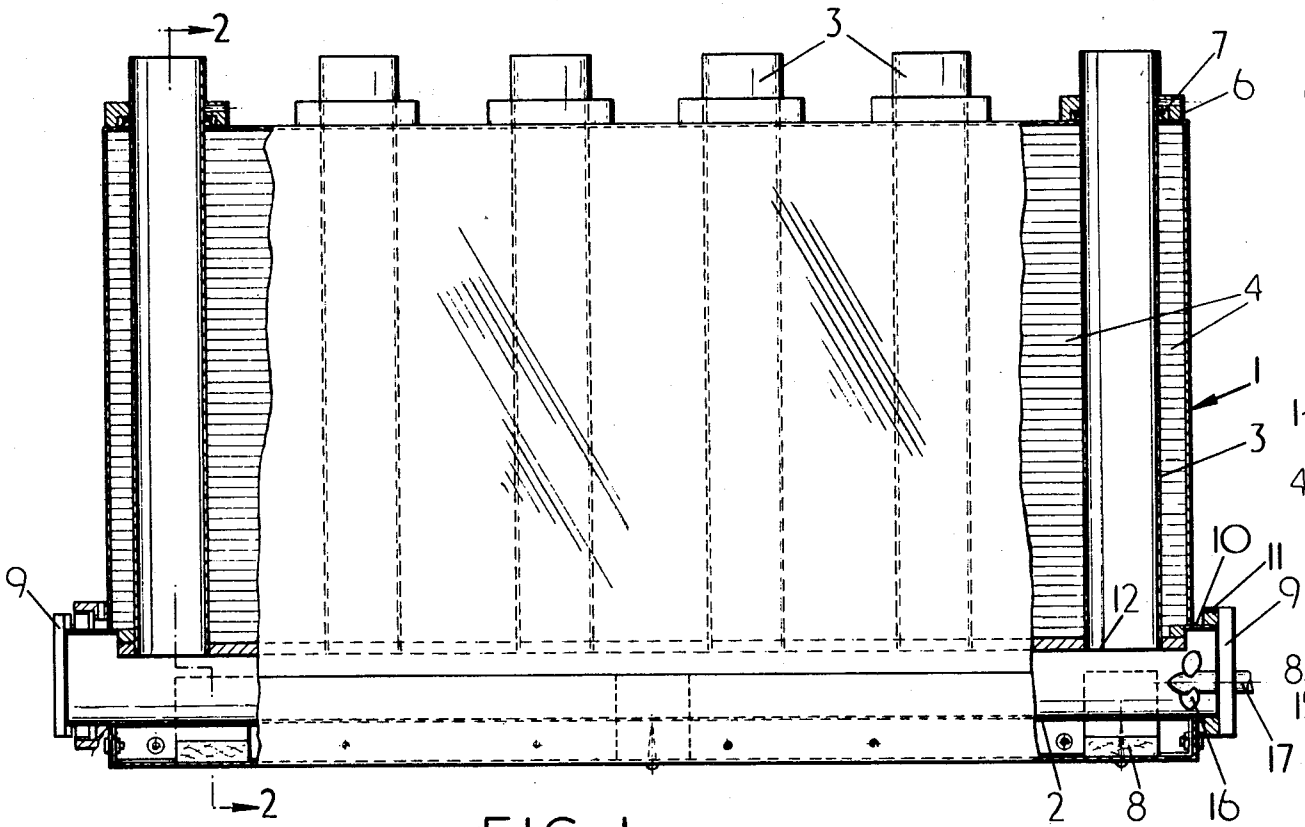

A practical embodiment of the invention is illustrated in the accompanying drawings in which FIG. 1 is a side elevation in part section of a tank and FIG. 2 is a section through the line 2—2 in FIG. 1.

In the drawings 1 denotes a casing, 2 denotes an elongated chamber located in the lower half of the casing 1 and disposed parallel to the bottom of the casing 1, 3, denotes tubular shafts extending upwardly from the chamber 2 to the top of the casing 1 and 4 denotes thermal insulating material surrounding the chamber 2 and the tubular shafts 3. The elongated chamber 2 is in cross section the shape of a segment of a circle, i.e. it is of part-circular cross section with a flat top 5 into which the tubular shafts 3 are connected. The flat top 5 is constituted by a plate formed with holes each of a diameter to receive the lower end of a tubular shaft 3, the plate 5, the circular portion of the elongated chamber and the tubular shafts being welded to one another. The top of the casing 1 is fitted with a plate 6 formed with holes through which the tubular shafts 3 project. The tubular shafts 3 also project through packing rings 7 so that liquid spilled during filling of the tank cannot enter the casing. The assembly consisting of the elongated chamber 2 and the tubular shafts 3 is supported on chocks 8 located within the casing 1. The ends of the elongated chamber 2 are closed by closure members constituted by cover plates 9. To facilitate manufacture the elongated chamber is made from a circular tube a portion of the circumference of which between the ends is cut away as shown at 10, the flat plate 5 being fitted to bridge the cut-away portion. This makes it possible to fit circular flanges 11 to the circular ends 12 of the chamber and to employ circular cover plates 9 to close the ends of the chamber. 13 denotes a cover plate fitted over an aperture 14 in the casing 1 through which insulation is introduced into the casing 1. To facilitate withdrawal of the elongated chamber 2 and the shafts 3 from the casing 1 the bottom of the casing 1 is made separate from the sides and is attached to the sides by screws 15. 16 denotes an agitating device in the form of an impeller located within the elongated chamber 2, the impeller being mounted on a driving shaft 17 passing through one of the cover plates 9.

In practice, liquid is introduced into the elongated chamber 2 and rises up the tubular shafts 3. Normally the articles to be treated are treated in the tubular shafts 3. They are inserted into the tubular shafts, remain there for the appropriate period and then removed. The area open to the atmosphere is thus kept to only that necessary for introduction of the article and loss or gain of heat or evaporation or condensation and danger of spillage are all reduced to a minimum. The elongated chamber 2 is completely enclosed and totally filled and provides a reservoir which being completely surrounded by the insulating material 4 suffers little heat gain or loss. Another very important advantage of the invention is apparent in environments where considerable vibration or violent movement is imparted to the tank. Owing to the small surface area of liquid exposed compared with the total volume of liquid present even quite violent movements do not disturb the surface of the liquid to any great extent and reduce the danger of spillage. Any small spillage which may take place during filling of the tank for example is arrested by the packing rings 7 and prevented from entering the casing 1.

The tank presents considerable advantages when used with the process which is the subject of the applicant's patent No. 3,560,140. In performance of the process of that patent thread is conducted at high speed into liquid ammonia at a temperature of −33° C. At this low temperature it is essential that the ammonia should present the minimum surface area to the atmosphere otherwise excessive evaporation and loss of ammonia occurs. In use of the tank of the present invention the pulleys around which the yarn is led are supported by bars which are arranged to project into respective tubular shafts 3 and the cross-sectional dimensions of the tubular shafts 3 are arranged to be the minimum necessary to admit the bar with the attached pulleys. Adequate impregnation with liquid ammonia thus takes place with minimum exposure of liquid ammonia to the atmosphere yet a sufficiently large volume is maintained in the tank, mainly in the elongated chamber 2, to maintain the low temperature required for the liquid ammonia.

The tank of the invention is particularly easily cleaned by removing the cover plates 9 at the ends of the elongated chamber and passing a cleaning mop through the chamber 2. Similarly the tubular shafts 3 may be cleaned by passing mops downwardly through them.

The tubular shafts 3 may be used as guides for the articles to be treated and the confining walls are effective to contain splashing as the articles enter the liquid in the tubular shafts. The close fit of the articles in the tubular shafts also causes some amount of pumping action to take place so that liquid from the elongated chamber 2 is circulated into the tubular shafts 3 and does not remain static. Where a change of concentration takes place in a liquid during the treatment as happens in some processes the change of concentration is thus distributed evenly throughout the tank and there is consequently less speedy change in concentration in the places where the treatment is actually taking place. Thus one charge of liquid may last longer before requiring replacement than is the case in tanks of conventional construction and there is normally no need to provide means for artificial agitation even in chemical processes where it is a normal requirement that the liquid used in the process should be agitated because of the rapid exhaustion of liquid at the point of treatment. However, if some artificial agitation is considered necessary it is easy to arrange for this by providing that an impeller 16 projects into the elongated chamber 2 through one of the end cover plates 9. Here once again the construction of the tank of the invention shows its advantage in that even with considerable agitation taking place in the elongated chamber 2 the agitation is largely damped by the time it reaches the tubular shafts 3 and there is little or no movement apparent on the surface. The impeller is easily removed for inspection and cleaning by merely removing the cover plate carrying it.

What is claimed is:

1. A tank for holding liquid comprising a casing, an elongated horizontal chamber disposed in the lower half of said casing, removable closure means accessible from the exterior of the casing for closing the ends of the chamber, a plurality of parallel vertical tubular shafts open at the top projecting upwardly from the chamber to the top of said casing and thermal insulating material surrounding the chamber and the vertical shafts within the casing.

2. A tank as claimed in claim 1 in which the casing has end walls and the ends of the chamber protrude through said end walls.

3. A tank as claimed in claim 1 in which the elongated chamber is in cross section the shape of a segment of a circle, i.e. it is of part circular cross section with a flat top, the tubular shafts being connected into the elongated chamber through the flat top.

4. A tank as claimed in claim 1 in which the top of the casing is closed by a plate formed with holes surrounded by packing rings through which the tubular shafts project.

5. A tank as claimed in claim 1 in which the elongated chamber is formed of a circular section tube having a portion of the tube wall between the ends of the tube cut away and a plate constituting the flat top bridging the cut edges.

6. A tank for holding liquid comprising a casing having end walls, an elongated horizontal chamber disposed in the lower half of the casing with its ends protruding through said end walls, removable closure means accessible from the exterior of the casing for closing the ends of the chamber, a plurality of parallel vertical tubular shafts open at the top projecting upwardly from the chamber to the top of said casing and thermal insulating material surrounding the chamber and the vertical shafts within the casing.

* * * * *